US007735285B2

(12) United States Patent
Payne, Jr.

(10) Patent No.: US 7,735,285 B2
(45) Date of Patent: Jun. 15, 2010

(54) ACOUSTICAL MOUNTING BRACKET FOR ATTACHING CEILING SUSPENSION TO FLOOR JOISTS

(75) Inventor: Stephen W. Payne, Jr., Wildwood, IL (US)

(73) Assignee: USG Interiors, Inc., Chicago, IL (US)

( * ) Notice: Subject to any disclaimer, the term of this patent is extended or adjusted under 35 U.S.C. 154(b) by 64 days.

(21) Appl. No.: 11/643,362

(22) Filed: Dec. 21, 2006

(65) Prior Publication Data

US 2008/0148667 A1 Jun. 26, 2008

(51) Int. Cl.
*E04B 9/18* (2006.01)

(52) U.S. Cl. ..... 52/506.07; 52/506.05; 52/506.08; 248/560; 248/609; 248/610

(58) Field of Classification Search ..... 52/506.07, 52/506.05, 506.08; 248/609, 560, 610, 621, 248/632, 674; 403/397
See application file for complete search history.

(56) References Cited

U.S. PATENT DOCUMENTS 2,499,278 A * 2/1950 Olsen ..... 52/714
2,638,303 A * 5/1953 Pietz ..... 267/140.3
3,558,091 A 1/1971 Bush
3,599,921 A 8/1971 Cumber
3,612,461 A 10/1971 Brown
3,649,741 A * 3/1972 Fremont ..... 174/491
4,040,758 A * 8/1977 Sauer ..... 403/397
4,115,484 A * 9/1978 Saxton ..... 261/111
4,402,171 A * 9/1983 Snyder ..... 52/745.05
4,566,233 A * 1/1986 Naka ..... 52/208
6,499,638 B2 * 12/2002 Campbell ..... 224/430
2005/0207866 A1 * 9/2005 Attanasio ..... 411/353

OTHER PUBLICATIONS

RSIC Product Guide, PAC International, Inc., www.pac-intl.com, pp. 1-30; Version Mar. 7, 2007.

* cited by examiner

*Primary Examiner*—Brian E Glessner
*Assistant Examiner*—James J Buckle, Jr.
(74) *Attorney, Agent, or Firm*—Greer, Burns & Crain, Ltd.; David F. Janci, Esq.; Pradip Sahu, Esq.

(57) ABSTRACT

A bracket for use in acoustically isolating a ceiling support grid from a frame member includes a planar body having a grid receiving formation and at least one mounting aperture, and a resilient grommet secured relative to each aperture for acoustically isolating a fastener passing through the aperture into the frame member.

5 Claims, 1 Drawing Sheet

ACOUSTICAL MOUNTING BRACKET FOR ATTACHING CEILING SUSPENSION TO FLOOR JOISTS

FIELD OF THE INVENTION

This invention relates generally to isolation devices used to acoustically isolate items from sources of vibrations, and more particularly to such devices or systems used for acoustically isolating adjacent living units in multi-family residences, as well as commercial structures typically having two or more stories. Furthermore, the present invention is applicable to other construction where high acoustical performance is desired.

A significant issue in housing construction and in multi-family housing construction in particular, is the acoustical isolation between rooms and living units which are horizontally or vertically adjacent. When suspended ceilings of wallboard or acoustical tile are utilized, the ceiling is typically suspended from a lower surface of the floor above. There is a desire for acoustically isolating the suspended ceiling from sound transmitted from the living space above, and particularly the floor from which the ceiling is suspended.

Currently, a variety of resilient channels and other sorts of isolation clips are used with varying degrees of cost and effectiveness. It is known to provide a resilient, formed metal channel fastened to a frame member such as wall supports (studs) or floor joists, and to then secure wallboard panels to the channel to isolate the wallboard from the underlying supports. In this scenario, sound transmission through the supports or joists is disrupted, and the space enclosed by the wallboard is somewhat insulated from outside noise. One source of such channels is CEMCO, with the channel sold as RC-1 Resilient Channel. However, in some applications, the use of RC-1 type resilient channel has not provided the desired level of acoustical isolation.

It is also known to provide a clip for use in suspending a support channel from the underlying supports or joists. More specifically, an RSIC sound isolation clip is produced by PAC International, Inc. (www.pac-intl.com). RSIC clips include a metal bracket provided with a cylindrical resilient pad with a plurality of integral resilient standoffs for engaging the frame member, typically a floor joist or a vertical wall stud. Opposite the pad, the bracket is connected to each leg of a generally "u"-shaped or "hat" channel which defines a space between the pad and the wallboard panel which is secured to the channel. The pad provides the acoustical isolation between the frame member and the wallboard panel.

One drawback of these clips is their relatively high cost, which can approach several dollars each. In addition, the RSIC clip system described above involves a relatively rigid attachment system of the wallboard panel to the frame member. Under the general principles of sound transmission, such rigid attachment generally correlates to a more efficient transmission of sound energy. Thus, such known clip systems are relatively costly for the amount of sound isolation provided.

Sound rated floors are typically evaluated by ASTM Standard #E492 and are rated as to Impact Insulation Class (IIC). The greater the IIC rating, the less-impact noise will be transmitted to the area below in the case of floors. Floors may also be rated as to Sound Transmission Class (STC) per ASTM E90. The greater the STC rating, the less airborne sound will be transmitted to the area below. Desired IIC ratings for such wallboard systems are at least 50 and most preferably approaching 60.

Another factor in conventional sound insulation systems, particularly when ceilings are suspended from wooden floor joists using hanger wires, with or without acoustical isolators, is that installation of the ceiling often results in a significant loss of ceiling height. This drawback restricts the use of suspended ceilings in many buildings.

One attempted solution of this problem is to suspend the grid from clips which are mounted directly to the floor joists. However, conventional clip systems are relatively complicated and expensive. Also, when improperly installed, which is a frequent occurrence, the desired levels of sound insulation are not achieved.

Thus, there is a need for an improved system for reducing acoustical transmission of adjacent living units through suspended ceilings. There is also a need for an improved system for reducing acoustical transmission and ceiling height loss between living units having suspended ceilings.

BRIEF DESCRIPTION OF THE INVENTION

The above-listed needs are met or exceeded by the present mounting bracket used for attachment of suspension grids for supporting wallboard or acoustic tile ceilings relative to a frame member (floor joists or similar framing member) in which a rigid bracket member has a formation for receiving the suspension grid, and at least one mounting aperture provided with resilient or rubber-like grommets. Fasteners passing through the respective apertures and directly into the frame member for securing the brackets in place are acoustically isolated from the bracket and the suspension grid by the grommets. In the preferred embodiment, the grid receiving formation is located at a first end of the bracket, and the apertures with grommets are located at a second, opposite end of the bracket.

More specifically, a bracket for use in acoustically isolating a ceiling support grid from a frame member includes a planar body having a grid receiving formation, and at least one mounting aperture, and a resilient grommet secured relative to each aperture for acoustically isolating a fastener passing through the aperture into the frame member.

In another embodiment, a bracket for use in acoustically isolating a ceiling support grid from a frame member includes a planar body having a lower end having a grid receiving formation, and an upper end opposite the lower end having a pair of mounting apertures. A resilient grommet is secured relative to each aperture for acoustically isolating a fastener passing through aperture into the frame member.

In yet another embodiment, a bracket for use in acoustically isolating a ceiling support grid from a frame member includes a planar body having a lower end having a grid receiving formation, and an upper end opposite the lower end having a pair of mounting apertures. A resilient grommet secured in each aperture for acoustically isolating a fastener passing through each aperture into the frame member. The apertures and the grid receiving formation project through the body transversely to a plane defined by the body. The body has a first portion accommodating the mounting apertures, and a second portion accommodating grid receiving formation, the first and second portions being integral and the second portion being tapered toward a lower edge of the body.

DETAILED DESCRIPTION OF THE INVENTION

Figure 3:
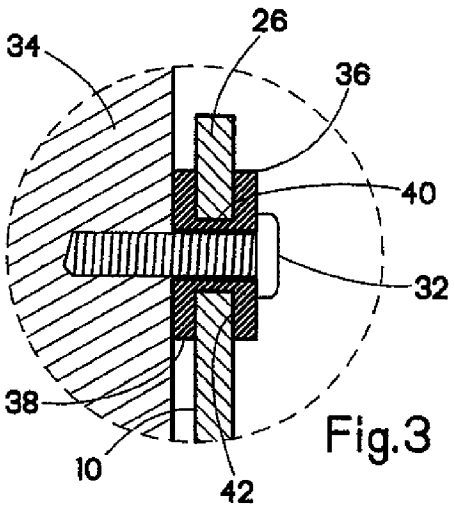
FIG. 3 is a fragmentary enlarged view of the grommet assembled on the bracket of FIG. 2.
Figure 2:
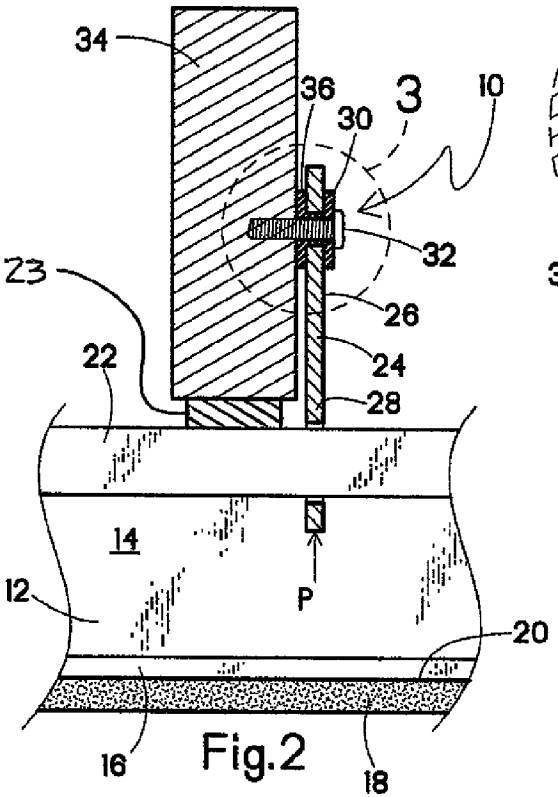
FIG. 2 is a side elevation of the bracket assembled to a ceiling frame of FIG. 1 with the bracket shown in section.
Figure 1:
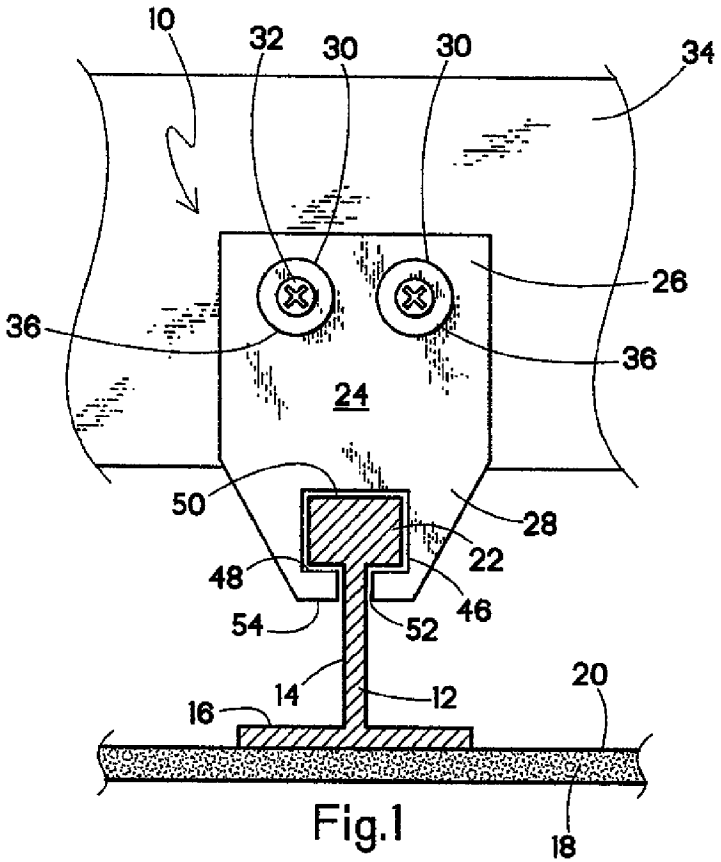
FIG. 1 is a front view of the present bracket shown assembled to a suspended ceiling frame, specifically, a wallboard suspension main tee shown in section.

Referring now to FIGS. 1-3, the present bracket is generally designated 10, and is depicted accommodating a ceiling support grid 12, preferably a drywall suspension main tee including a main web 14, and a lower support flange 16 to which a wallboard ceiling panel 18 is attached along an upper face 20. The attachment is accomplished by fasteners (not shown) as well known in the art. A generally rectangular cross-sectioned bulb or bead 22 is provided at an upper end of the web 14. While a suspended wallboard ceiling is depicted and described, it will be understood that the present bracket 10 may be used with a variety of conventional suspended ceiling support grids by being modified as discussed below. One such alternative is to provide acoustical tile which rests upon the support flange 16 as is well known in the art.

The bracket 10 includes a planar body 24 with a first or upper end 26 and an opposite second or lower end 28. It is preferred that the first and second ends 26, 28 are integral, and the body unitary. While other shapes are contemplated, the upper end 26 is polygonal, and the lower end 28 is tapered toward a lower edge opposite the upper end 26. At least one mounting aperture 30 is provided on the body, preferably two such apertures being located on the upper end 26. While the apertures 30 are preferably laterally spaced from each other in the upper end 26, other orientations are contemplated depending on the application.

A fastener 32 such as a threaded screw or the like secures the bracket 10 to a supporting frame member 34 such as a wooden floor joist. However, other types of joists or frame members are contemplated as being suitable for use with the present bracket 10, as is non-wooden construction. To provide acoustical isolation between the frame member and the assembled ceiling panel 18, the ceiling support grid 12 and the bracket 10, each aperture 30 is provided with a resilient, rubber-like grommet 36 with relatively larger diameter exterior portions 38 axially separated by a smaller diameter portion 40 forming a groove 42 dimensioned for accommodating the body 10. The groove 42 engages a peripheral edge of the aperture 30. It is contemplated that the grommet 36 is made from rubber or other similar, resilient material, including soft plastic or the like. The grommet 36 defines a fastener-receiving bore 44 which, upon installation is in registry with the mounting aperture 30.

Referring now to FIG. 1, a grid receiving formation 46 is defined by the body 24, and is preferably located in the lower end 28. The grid receiving formation 46 is constructed and arranged to slidingly receive the ceiling support grid 12, and preferably the bulb 22. Thus, in view of the preferred grid 12 being a main tee, the grid receiving formation 46 defines a generally "T"-shaped opening 48, including a first, quadrilateral-shaped main portion 50 configured for receiving the bulb or bead 22, which is in communication with a narrower slot 52 opening to a peripheral edge 54 of the body. In the event other shapes of bulbs 22 are provided, the main portion 50 may be modified to slidingly accommodate the varied shape.

A feature of the present bracket 10 is that the mounting apertures 30 and the grid receiving formation 46 project through the body 24 transversely to a plane "P" defined by the body (FIG. 2). This orientation provides for the support grid 12 to be disposed transversely to the frame member 34, and also for the bracket 10 to be oriented parallel to the frame member upon assembly.

Ceiling installation is accomplished by first inserting the main tee 12 through the T-shaped opening 48 of the bracket 10. A sufficient number of brackets 10 are installed on the main tee 12 which generally correspond to the number of frame members 34. Typically, relatively long lengths of support grid or main tee 12 are slid into a row of aligned brackets 10. The bulb 22 is engaged by the main portion 50 of the opening 48, and the web 14 is slidingly engaged in the slot 52. Next, the assembled brackets 10 and main tee 12 are positioned upon the frame members 34 so that they are in proper vertical and horizontal alignment. One technique for maintaining consistent vertical alignment is to provide a spacer 23 between an upper edge of the bulb 22 and a lower edge of the frame member 34. The fastener 32 is then inserted through the fastener receiving bore 44 of the grommet 36 and driven into the frame member 34 to attach the bracket 10 and the associated main tee 12 to the frame member. The grommet 36 acoustically isolates the fastener 32 and the frame member 34 from the bracket 10 and the corresponding support grid or main tee 12.

Next, the wallboard panels 18 are secured to the flange 16 using fasteners as known in the art. If acoustic ceiling tiles are provided, they are placed on top of the flanges 16 per industry custom. In this manner sound waves transmitted through the joist or other frame member 34 are isolated from the bracket 10 and the support grid 12.

While a particular embodiment of the present acoustical mounting bracket for attaching a ceiling suspension to floor joists has been shown and described, it will be appreciated by those skilled in the art that changes and modifications may be made thereto without departing from the invention in its broader aspects and as set forth in the following claims.

What is claimed is:

1. A bracket for use in acoustically isolating a ceiling support grid from a frame member, said bracket comprising:

a planar body including an upper portion and a lower portion, said upper portion having an upper edge and first opposing, side edges defining a uniform width, wherein said upper edge is substantially straight and extends from one of said first side edges to the other of said first side edges, said upper portion including two laterally spaced mounting apertures, said lower portion having opposing, second side edges respectively extending from said first side edges to a bottom edge opposite to said upper edge, wherein said bottom edge is parallel to said upper edge and has a width that is less than said uniform width of said upper portion, said lower portion including a grid receiving formation defining a "T"-shaped opening; and a unitary, resilient grommet secured relative to each said aperture for acoustically isolating a fastener passing through each said aperture into the frame member, said grommet being in direct contact with the fastener and the frame member and including planar members spaced apart axially along a longitudinal axis of the fastener and extending radially from each of said apertures on opposing sides of said planar body.

2. The bracket of claim 1 wherein said two mounting apertures and said grid receiving formation project through said body transversely to a plane defined by said body.

3. The bracket of claim 1 wherein said opening includes a first, quadrilateral-shaped main portion which is in communication with a narrower slot opening to a peripheral edge of said body.

4. The bracket of claim 1 wherein said ceiling support grid has a bead, and said grid receiving formation defines a complementary opening for slidably receiving said bead.

5. A bracket mounting system for use in acoustically isolating a ceiling support grid from a frame member, said bracket system comprising:

a planar body having a lower portion having a bottom edge defining a lower width and defining a "T"-shaped grid receiving formation, and an upper portion adjacent to said lower portion and having an upper width, said upper portion having an upper edge extending along said upper width and including a pair of laterally spaced mounting apertures, said upper and lower portions being integral, wherein said upper edge is parallel to said bottom edge, and wherein said upper width is greater than said lower width;

a unitary, resilient grommet secured in each said aperture for acoustically isolating a fastener passing through each said aperture into the frame member, said grommet being in direct contact with the fastener and the frame member and including planar members spaced apart along a longitudinal axis of the fastener and extending radially from each of said apertures on opposing sides of said planar body at said apertures;

said apertures and said grid receiving formation projecting through said body transversely to a plane defined by said body; and a spacer positioned between the support grid and the frame member to help maintain vertical alignment of said planar body on the frame member.

* * * * *